US011443689B1

(12) United States Patent
Zhai

(10) Patent No.: US 11,443,689 B1
(45) Date of Patent: Sep. 13, 2022

(54) LIGHT-EMITTING ELEMENT CONTROL CIRCUIT, DISPLAY PANEL AND DISPLAY DEVICE

(71) Applicant: Xiamen Tianma Micro-Electronics Co., Ltd., Xiamen (CN)

(72) Inventor: Yingteng Zhai, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/363,679

(22) Filed: Jun. 30, 2021

(30) Foreign Application Priority Data

Feb. 20, 2021 (CN) ..... 202110194514.5

(51) Int. Cl.
*G09G 3/32* (2016.01)

(52) U.S. Cl.
CPC ..... *G09G 3/32* (2013.01); *G09G 2320/0233* (2013.01); *G09G 2320/064* (2013.01); *G09G 2330/02* (2013.01)

(58) Field of Classification Search
CPC ..... G09G 2320/0233; G09G 2330/02; G09G 3/32; G09G 2320/064
See application file for complete search history.

(56) References Cited

U.S. PATENT DOCUMENTS 7,760,172 B2 * 7/2010 Huh ..... G09G 3/3233 345/55
2003/0016191 A1 * 1/2003 Nakamura ..... G09G 3/3233 345/55
2011/0068701 A1 * 3/2011 van de Ven ..... H05B 45/48 315/309
2013/0257827 A1 * 10/2013 Hsieh ..... G09G 3/342 345/82
2017/0309224 A1 * 10/2017 Pappas ..... G09G 3/3233

FOREIGN PATENT DOCUMENTS

CN 1716350 A 1/2006
CN 104106315 A 10/2014
CN 109671397 A 4/2019
CN 111540307 A 8/2020

OTHER PUBLICATIONS

The First Office Action for Chinese Application No. 202110194514.5, dated Oct. 11, 2021, ten (10) pages.

* cited by examiner

*Primary Examiner* — Muhammad N Edun
(74) *Attorney, Agent, or Firm* — KDB Firm PLLC

(57) ABSTRACT

Provided is a light-emitting element control circuit, a display panel and a display device. The light-emitting element control circuit includes a current source and at least one light-emitting unit, and the at least one light-emitting unit is connected in series to the current source. The at least one light-emitting unit each includes a first branch and a second branch which are connected in parallel. The first branch includes a first gating unit and a light-emitting element which are connected in series, and the second branch includes a second gating unit. The light-emitting element control circuit provided by the present application enables the current provided by the current source to pass through one of the first branch and the second branch in an active-selection mode, and meanwhile generation of photo-generated carriers in the light-emitting element can be avoided, thereby improving the display effect.

17 Claims, 13 Drawing Sheets

LIGHT-EMITTING ELEMENT CONTROL CIRCUIT, DISPLAY PANEL AND DISPLAY DEVICE

CROSS-REFERENCE TO RELATED APPLICATION(S)

This application claims priority to Chinese Patent Application No. 202110194514.5 filed Feb. 20, 2021, the disclosure of which is incorporated herein by reference in its entirety.

TECHNICAL FIELD

The present disclosure relates to the field of display techniques and, in particular, to a light-emitting element control circuit, a display panel and a display device.

BACKGROUND

A light-emitting diode (LED) always has a place in the field of display techniques due to advantages such as fast response speed, high luminous brightness and long service life. With the continuous reduction in size of the LED, types of LED display screens are gradually expanding from a large-size display screen to a small and medium-size display screen.

Currently, in a circuit in which a plurality of LEDs are connected in series, the LED is usually controlled to switch from a light-emitting state to a non-light-emitting state through a mode in which the LED is short-circuited. This mode easily causes a problem such that the LED still generates photo-generated carriers and thus the brightness of other LEDs is affected.

SUMMARY

In view of this, the present disclosure provides a light-emitting element control circuit, a display panel and a display device to solve the preceding problem.

To achieve the preceding object, the present disclosure provides technical solutions described below.

In a first aspect, the present disclosure provides a light-emitting element control circuit, and the light-emitting element control circuit includes a current source and at least one light-emitting unit.

The at least one light-emitting unit is connected in series to the current source.

The at least one light-emitting unit each includes a first branch and a second branch which are connected in parallel. The first branch includes a first gating unit and a light-emitting element which are connected in series, and the second branch includes a second gating unit.

In a second aspect, the present disclosure provides a display panel, and the display panel includes the light-emitting element control circuit described above.

In a third aspect, the present disclosure provides a display device, and the display device includes the display panel described above.

Compared with the related art, the technical solutions provided by the present disclosure have at least the advantages described below.

The current source in the light-emitting element control circuit supplies the current to the light-emitting unit, and the first branch and the second branch connected in parallel are both provided with the gating unit, so that the current provided by the current source can pass through one of the first branch and the second branch in an active-selection mode. In addition, in the first branch, the first gating unit is connected in series to the light-emitting element, and when the first gating unit is turned off, the first branch is open. Compared with the light-emitting element that is short-circuited by the bypass and does not emit light, the light-emitting element control circuit can avoid generation of photo-generated carriers in the light-emitting element, thereby avoiding bringing influence to the display.

BRIEF DESCRIPTION OF DRAWINGS

To illustrate the technical solutions in the embodiments of the present disclosure or the technical solutions in the related art more clearly, drawings used in the description of the embodiments or the related art will be briefly described below. Apparently, the drawings described below are merely embodiments of the present disclosure, and those skilled in the art may obtain other drawings based on provided drawings on the premise that no creative work is done.

DETAILED DESCRIPTION

The technical solutions in the embodiments of the present disclosure will be described clearly and completely in connection with the drawings in the embodiments of the present disclosure. Apparently, the embodiments described below are part, not all, of the embodiments of the present disclosure. Based on the embodiments of the present disclosure, all other embodiments obtained by those skilled in the art without creative work are within the scope of the present disclosure.

Figure 1:
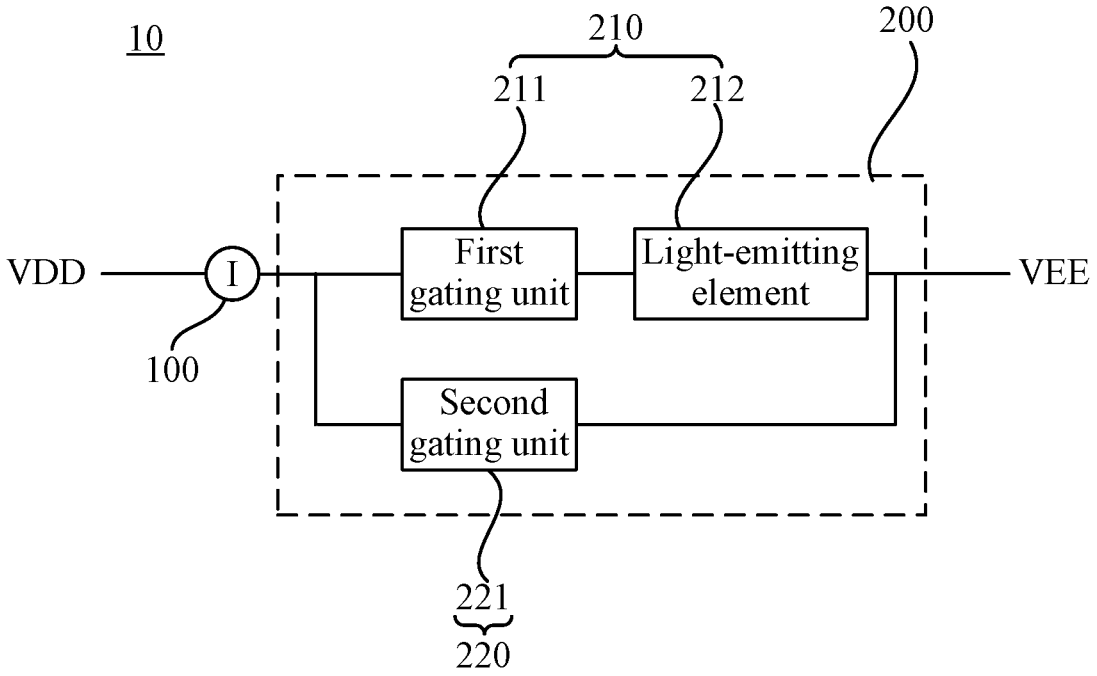
FIG. 1 is a schematic diagram of a light-emitting element control circuit according to an embodiment of the present disclosure.

FIG. 1 is a schematic diagram of a light-emitting element control circuit according to an embodiment of the present disclosure.

As shown in FIG. 1, the present application provides a light-emitting element control circuit 10, and the light-emitting element control circuit 10 includes a current source 100 and at least one light-emitting unit 200. The current source 100 is connected in series to the light-emitting unit 200 and used for supplying a current to the light-emitting unit 200. The current provided by the current source 100 is a constant current.

The light-emitting unit 200 includes a first branch 210 and a second branch 220 which are connected in parallel.

The first branch 210 includes a first gating unit 211 and a light-emitting element 212 which are connected in series. The first gating unit 211 is configured to control an on-off state of the first branch 210 so as to control light-emitting or non-light-emitting of the light-emitting element 212. When the first gating unit 211 is in an on state, the current provided by the current source 100 passes through the first branch 210 and the light-emitting element 212 emits light. Conversely, when the first gating unit 211 is in an off state, the current provided by the current source 100 does not pass through the first branch 210 and the light-emitting element 212 does not emit light.

The second branch 220 includes a second gating unit 221. Similarly, the second gating unit 221 is configured to control an on-off state of the second branch 220. When the second gating unit 221 is in an on state, the current provided by the current source 100 passes through the second branch 220. Conversely, when the second gating unit 221 is in an off state, the current provided by the current source 100 does not pass through the second branch 220.

In this manner, the current source 100 in the light-emitting element control circuit 10 supplies the current to the light-emitting unit 200, and the first branch 210 and the second branch 220 connected in parallel are both provided with the gating unit, so that the current provided by the current source 100 can pass through one of the first branch 210 and the second branch 220 in an active-selection mode. In addition, in the first branch 210, the first gating unit 211 is connected in series to the light-emitting element 212, and when the first gating unit 211 is turned off, the first branch 210 is open. Compared with the light-emitting element that is short-circuited by the bypass and does not emit light, the light-emitting element control circuit can avoid generation of photo-generated carriers in the light-emitting element 212, thereby avoiding bringing influence to the display.

Figure 2:
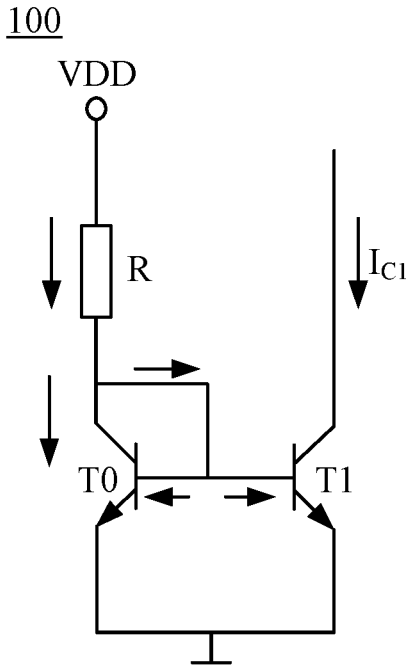
FIG. 2 is a circuit diagram of a current source according to an embodiment of the present disclosure.

FIG. 2 is a circuit diagram of a current source according to an embodiment of the present disclosure.

As shown in FIG. 2, the current source 100 may include two transistors T0 and T1 and a resistor R. The transistor T0 is connected to a first power supply terminal VDD through the resistor R, the first power supply terminal VDD is used for providing a stable base voltage for the transistor T1, and the transistor T1 is configured to output a constant current IC1. FIG. 2 illustrates an example in which the current source 100 may be a current mirror circuit, and the current source 100 may also be other circuit structures capable of providing a constant current.

A relationship between the on state and the off state of the first gating unit 211 and the second gating unit 221 may include conditions described below. When the first gating unit 211 is in the on state, the second gating unit 221 is in the off state. When the second gating unit 221 is in the on state, the first gating unit 211 is in the off state.

In this manner, that first gating unit 211 and the second gating unit 221 are not turned on at the same time so that the current provided by the current source 100 can pass through one of the first branch 210 and the second branch 220; and the states (on state or off state) of the first gating unit 211 and the second gating unit 221 are simultaneously determined so that which path of the first branch 210 and the second branch 220 that the current passes through is determined actively.

The first gating unit 211 and the second gating unit 221 may be transistors.

The transistor may be a metal oxide semiconductor (MOS) transistor and use a silicon wafer as a film-forming substrate.

The transistor may be a thin film transistor (TFT) and use glass or polyimide as the film-forming substrate.

Types of transistors of the first gating unit 211 and the second gating unit 221 are set and combined with a mode of providing a control signal, so that one of the first branch 210 and the second branch 220 has a current passing through and the other one of the first branch 210 and the second branch 220 is turned off.

In one embodiment, one of the first gating unit 211 and the second gating unit 221 is an N-type transistor and the other one of the first gating unit 211 and the second gating unit 221 is a P-type transistor, and a control terminal of the N-type transistor is electrically connected to a control terminal of the P-type transistor.

Figure 3:
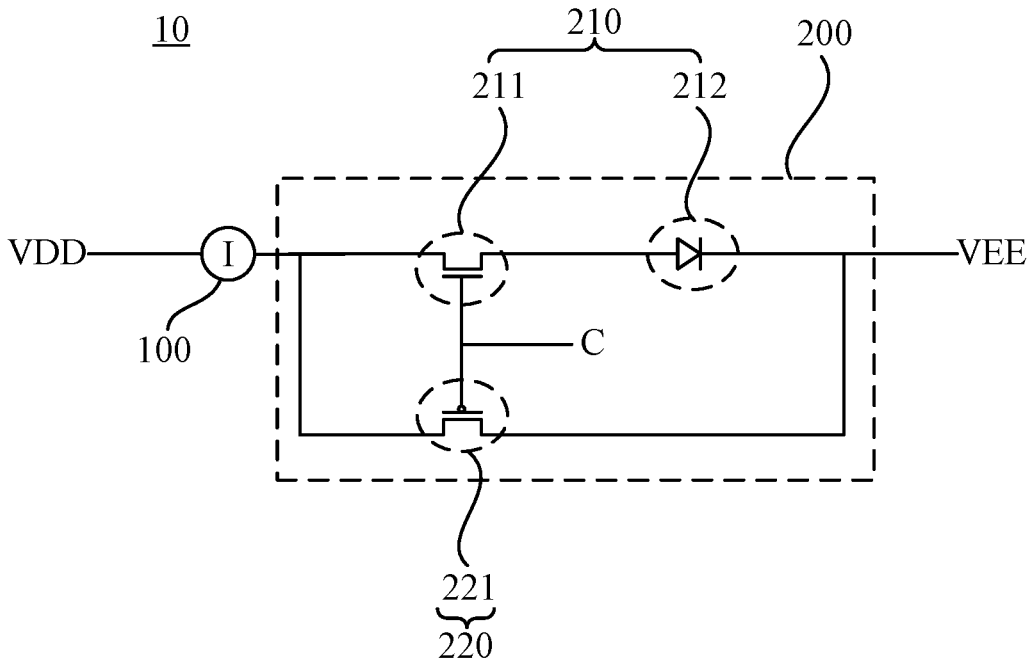
FIG. 3 is a schematic diagram of another light-emitting element control circuit according to an embodiment of the present disclosure.

FIG. 3 is a schematic diagram of another light-emitting element control circuit according to an embodiment of the present disclosure. As shown in FIG. 3, the first gating unit 211 may be the N-type transistor, the second gating unit 221 may be the P-type transistor, and the control terminal of the N-type transistor is electrically connected to the control terminal of the P-type transistor. In this manner, a same one control signal C may be used to control the on-off state of the N-type transistor as the first gating unit 211 and the P-type transistor as the second gating unit 221; and the N-type transistor is turned on when a gate voltage is higher than a source voltage and a voltage difference between a gate and a source is higher than a threshold voltage between the gate and the source, and the P-type transistor is turned on when a gate voltage is smaller than a source voltage and a voltage difference between a gate and a source is smaller than a threshold voltage between the gate and the source. In this manner, a same one control signal C such as a high potential may be used to enable the N-type transistor to be turned on and the P-type transistor to be turned off at the same time;

or a same one control signal C such as a low potential may be used to enable the N-type transistor to be turned off and the P-type transistor to be turned on at the same time. Therefore, a same one control signal is used to control one of the first branch 210 and the second branch 220 to be turned on so that the current provided by the current source 100 passes through the one branch, while the other one branch is turned off.

As for the types of transistors constituting the first gating unit 211 and the second gating unit 221, unlike FIG. 3, the first gating unit 211 may be the P-type transistor and the second gating unit 221 may be the N-type transistor. Moreover, the control terminal of the P-type transistor is electrically connected to the control terminal of the N-type transistor.

In another embodiment, the type of the transistor of the first gating unit 211 may be the same as the type of the transistor of the second gating unit 221. For example, both of the first gating unit 211 and the second gating unit 221 may be N-type transistors, or both of the first gating unit 211 and the second gating unit 221 may be P-type transistors.

In this embodiment, the light-emitting unit 200 further includes an inverter 230, and a control terminal of the first gating unit 211 is electrically connected to a control terminal of the second gating unit 221 through the inverter 230.

Figure 4:
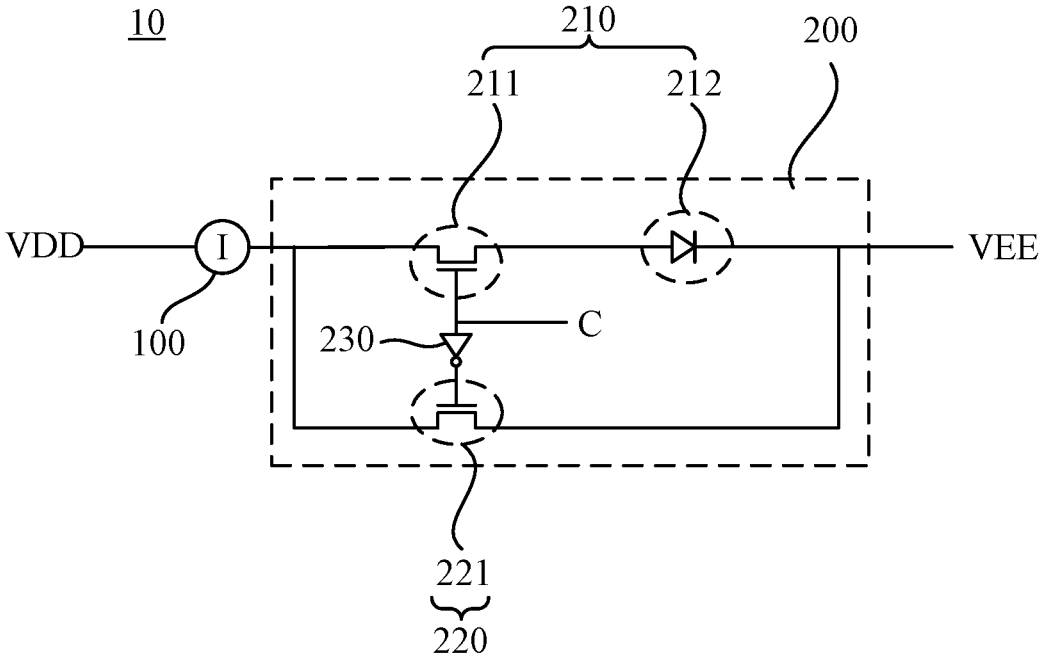
FIG. 4 is a schematic diagram of another light-emitting element control circuit according to an embodiment of the present disclosure.

FIG. 4 is a schematic diagram of another light-emitting element control circuit according to an embodiment of the present disclosure. As shown in FIG. 4, both of the first gating unit 211 and the second gating unit 221 being the N-type transistor is described as an example. The control terminal of the first gating unit 211 is connected to the control terminal of the second gating unit 221 through the inverter 230, and the control signal is directly provided to the control terminal of the first gating unit 211.

Figure 5:
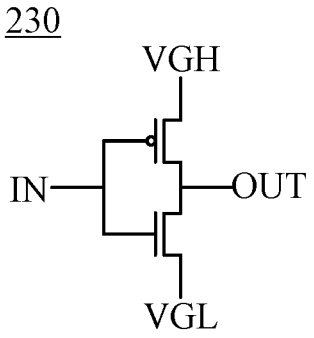
FIG. 5 is a schematic diagram of an inverter according to an embodiment of the present disclosure.

FIG. 5 is a schematic diagram of an inverter according to an embodiment of the present disclosure. As shown in FIG. 5, the inverter 230 includes a P-type transistor and an N-type transistor, a control terminal of the P-type transistor is electrically connected to a control terminal of the N-type transistor and serves as an input terminal IN of the inverter 230; one end of the P-type transistor is electrically connected to one end of the N-type transistor and serves as an output terminal OUT of the inverter 230; and another end of the P-type transistor receives a high level VGH, and another end of the N-type transistor receives a low level VGL, where the high level VGH is higher than the low level VGL.

When a signal received by the input terminal IN of the inverter 230 is at a low level, the P-type transistor is turned on, the N-type transistor is turned off, and the high level VGH is transmitted to the output terminal OUT of the inverter 230 through the P-type transistor. Similarly, when the signal received by the input terminal IN of the inverter 230 is at a high level, the N-type transistor is turned on, the P-type transistor is turned off, and the low level VGL is transmitted to the output terminal OUT of the inverter 230 through the N-type transistor. In this manner, the inverter 230 reverses a phase of the signal received by the input terminal IN.

In conjunction with FIGS. 4 and 5, when the circuit operates, the control signal C may be directly provided to the control terminal of the first gating unit 211 to control the on-off state of the first gating unit 211; and at the same time, the control signal C may be provided to the input terminal IN of the inverter 230, and the inverter 230 inverts the phase of the control signal and outputs the control signal from the output terminal OUT of the inverter 230 to the control terminal of the second gating unit 221 to control the on-off state of the second gating unit 221.

The control signal C being the high level and both of the first gating unit 211 and the second gating unit 221 being the N-type transistor is described as an example. The control signal C is directly provided to the control terminal of the first gating unit 211, and the signal received by the control terminal is at the high level, so that the first gating unit 211 is turned on. At the same time, the control signal C is provided to the input terminal IN of the inverter 230, and the inverter 230 inverts the phase of the control signal C and transmits the control signal C from the output terminal OUT of the inverter 230 to the control terminal of the second gating unit 221. At this time, the signal received by the control terminal is at the low level, and the second gating unit 221 is turned off. In this manner, the first branch 210 is controlled to be turned on and the second branch 220 is controlled to be turned off.

In this embodiment, the control terminal of the first gating unit 211 is connected to the control terminal of the second gating unit 221 through the inverter 230, and the transistor of the first gating unit 211 has a same type as the transistor of the second gating unit 221. In this manner, one control signal C is used to enable that phases of the signal received by the control terminal of the first gating unit 211 and the control terminal of the second gating unit 221 at the same time is reversed, so that one of the first gating unit 211 and the second gating unit 221 is turned on and the other one is turned off.

Figure 6:
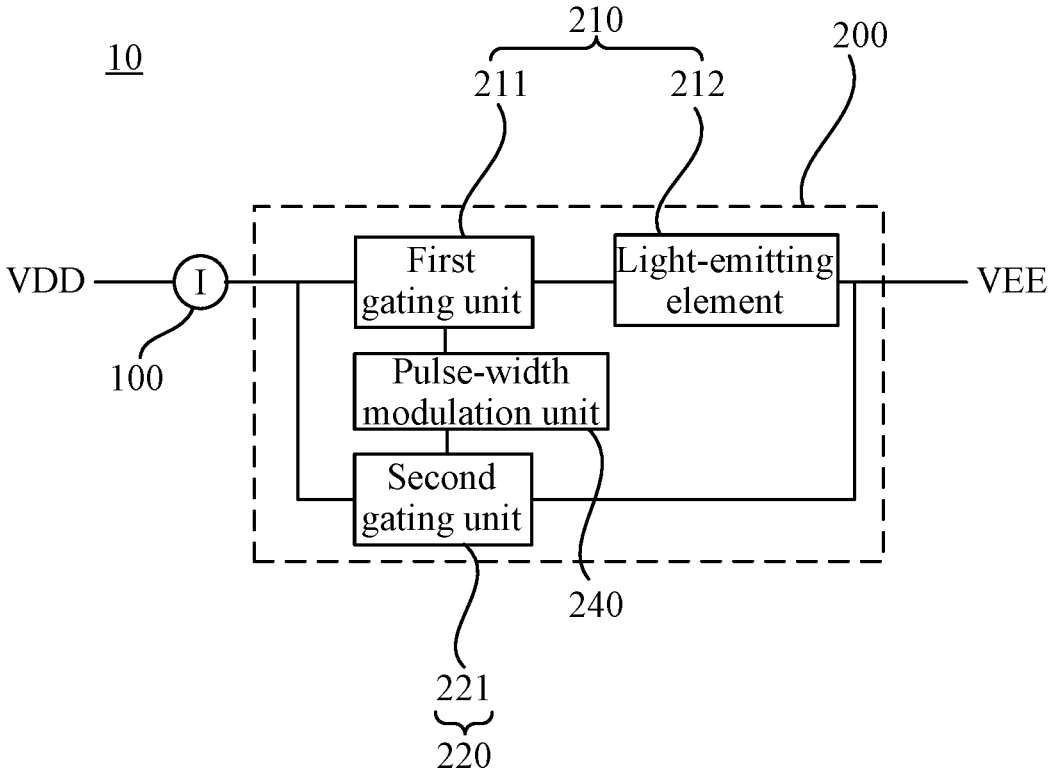
FIG. 6 is a schematic diagram of another light-emitting element control circuit according to an embodiment of the present disclosure.

FIG. 6 is a schematic diagram of another light-emitting element control circuit according to an embodiment of the present disclosure. As shown in FIG. 6, the light-emitting unit 200 may include a pulse-width modulation unit 240, the pulse-width modulation unit 240 is electrically connected to the first gating unit 211 and the second gating unit 221, respectively, and the pulse-width modulation unit 240 is configured to provide a pulse-width modulation (PWM) signal to the first gating unit 211 and the second gating unit 221, respectively. In conjunction with FIGS. 3 and 4, the pulse-width modulation signal output by the pulse-width modulation unit 240 may be used as the control signal C. An enable signal of the pulse-width modulation signal that enables the first gating unit 211 to be turned on is configured to enable the current provided by the current source 100 to pass through the first branch 210 so as to control the light emission duration of the light emitting element 212, while an enable signal of the pulse-width modulation signal that enables the second gating unit 221 to be turned on is configured to enable the current provided by the current source 100 to pass through the second branch 210.

The pulse-width modulation unit 240 is configured to receive a data signal and output a pulse-width modulation signal corresponding to the data signal.

Figure 7:
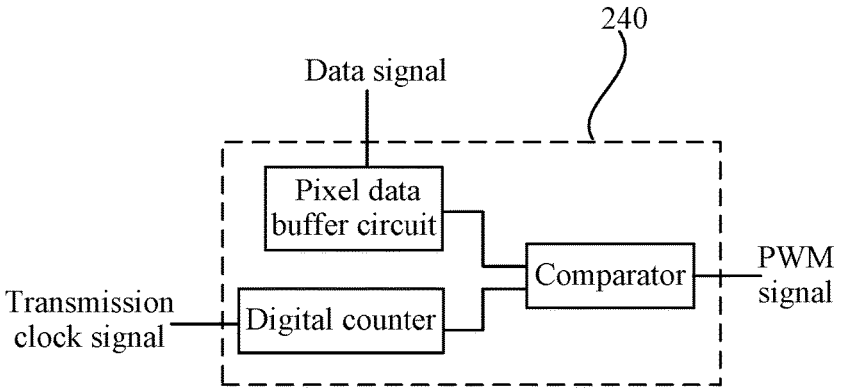
FIG. 7 is a schematic diagram of a pulse-width modulation unit according to an embodiment of the present disclosure.

FIG. 7 is a schematic diagram of a pulse-width modulation unit according to an embodiment of the present disclosure.

As shown in FIG. 7, the pulse-width modulation unit 240 may include a pixel data buffer circuit, a digital counter and a comparator. The pixel data buffer circuit is configured to receive and store the data signal (image data). The stored data signal may be configured to control the light-emitting element 212 of one light-emitting unit 200, or to control the light-emitting elements 212 of multiple light-emitting units 200. For example, the stored data signal is configured to control light-emitting elements 212 of two or three light-emitting units 200. The pixel data buffer circuit is configured to output a digital data signal to the comparator. The digital counter may receive a transmission clock signal and output a digital counting signal to the comparator. The comparator is configured to receive the digital data signal and the digital counting signal and output a light emission control signal (PWM signal).

The data signal represents a gray scale of a pixel of a picture. The data signal may be a digital signal or an analog signal (for example, a certain data signal is a voltage value).

Figure 8:
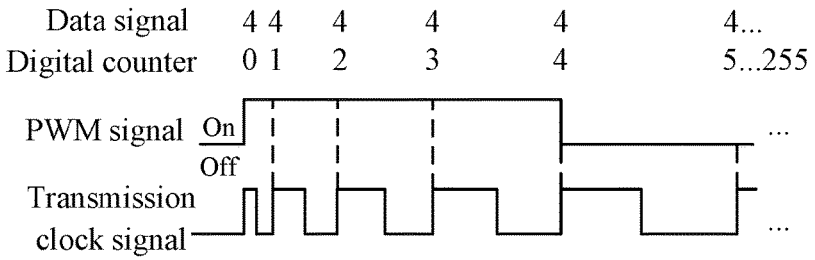
FIG. 8 is a signal timing diagram of the pulse-width modulation unit of FIG. 7.

FIG. 8 is a signal timing diagram of the pulse-width modulation unit of FIG. 7. The data signal representing the gray scale 4 is described as an example in FIG. 8. The comparator receives the digital data signal provided by the pixel data buffer circuit and the digital counting signal provided by the digital counter and outputs the light emission control signal (PWM signal). When the digital counting signal does not exceed the digital data signal, the PWM signal is in an on state; and otherwise, the PWM signal is in an off state.

PWM signals of other gray scales are formed similarly.

In FIGS. 1 to 4, the number of light-emitting units 200 connected in series to the current source 100 being one is described as an example.

Multiple light-emitting units 200 connected in series to the current source 100 may be provided, and the multiple light-emitting units 200 are connected in series.

Figure 9:
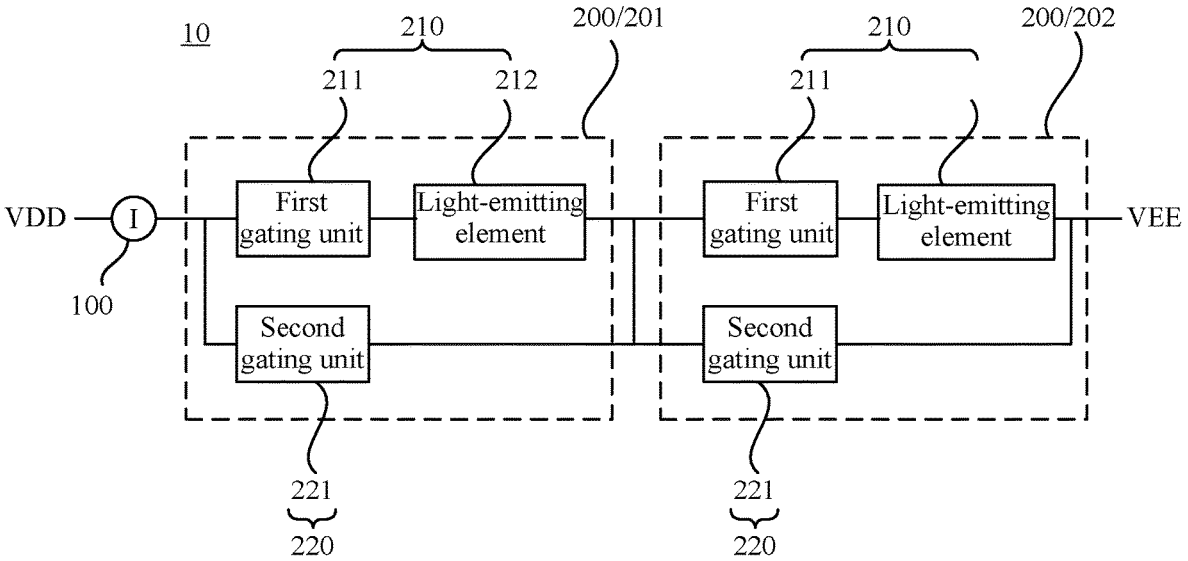
FIG. 9 is a schematic diagram of another light-emitting element control circuit according to an embodiment of the present disclosure.

FIG. 9 is a schematic diagram of another light-emitting element control circuit according to an embodiment of the present disclosure.

As shown in FIG. 9, the number of light-emitting units 200 being two is described as an example. The two light-emitting units 200 separately are a first light-emitting unit 201 and a second light-emitting unit 202, the first light-emitting unit 201 and the second light-emitting unit 202 are connected in series and connected in parallel to the current source 100.

When the first gating unit 211 of the first light-emitting unit 201 is turned on and the first gating unit 211 of the second light-emitting unit 202 is turned on, the light-emitting elements 212 of the two light-emitting units 200 both emit light. When the second gating unit 221 of the first light-emitting unit 201 is turned on and the second gating unit 221 of the second light-emitting unit 202 is turned on, both the light-emitting elements 212 of the two light-emitting units 200 do not emit light, and the current provided by the current source 100 passes through the second branches 220 of the two light-emitting units 200. When the first gating unit 211 of the first light-emitting unit 201 is turned on and the second gating unit 221 of the second light-emitting unit 202 is turned on, the current provided by the current source 100 passes through the first branch 210 of the first light-emitting unit 201 and the second branch 220 of the second light-emitting unit 202 sequentially, the light-emitting element 212 of the first light-emitting unit 201 emits light, and the light-emitting element 212 of the second light-emitting unit 202 does not emit light. When the second gating unit 221 of the first light-emitting unit 201 is turned on and the first gating unit 211 of the second light-emitting unit 202 is turned on, the current provided by the current source 100 passes through the second branch 220 of the first light-emitting unit 201 and the first branch 210 of the second light-emitting unit 202 sequentially, the light-emitting element 212 of the first light-emitting unit 201 does not emit light, and the light-emitting element 212 of the second light-emitting unit 202 emits light.

Similarly, when the number of light-emitting units 200 is greater than two, the on-off state of the first gating unit 211 and the second gating unit 221 of each light-emitting unit 200 may be controlled to select a path through which the current flows. In this manner, for multiple light-emitting units 200 connected in series, whether the light-emitting element 212 of each light-emitting unit 200 emits light does not affect the selection of whether light-emitting elements 212 of the other light-emitting units 200 emit light.

The current source 100 provides a constant current and power consumption is generally large. Therefore, using one current source 100 to drive one light-emitting element 212 consumes a relatively large amount of overall power. In this embodiment, one current source 100 drives multiple light-emitting elements 212, and each light-emitting unit 200 includes the first branch 210 provided with the light-emitting element 212 and the second branch 220 not provided with the light-emitting element 212. Therefore, whether the light-emitting element 212 of a certain light-emitting unit 200 emits light or not does not affect the light-emitting conditions of the light-emitting elements of other light-emitting units 200 connected in series therewith. On the basis of ensuring that each light-emitting element 212 normally emits light, the light-emitting element control circuit 10 of this embodiment reduces the number of current sources 100 and reduces the power consumption.

Figure 10:
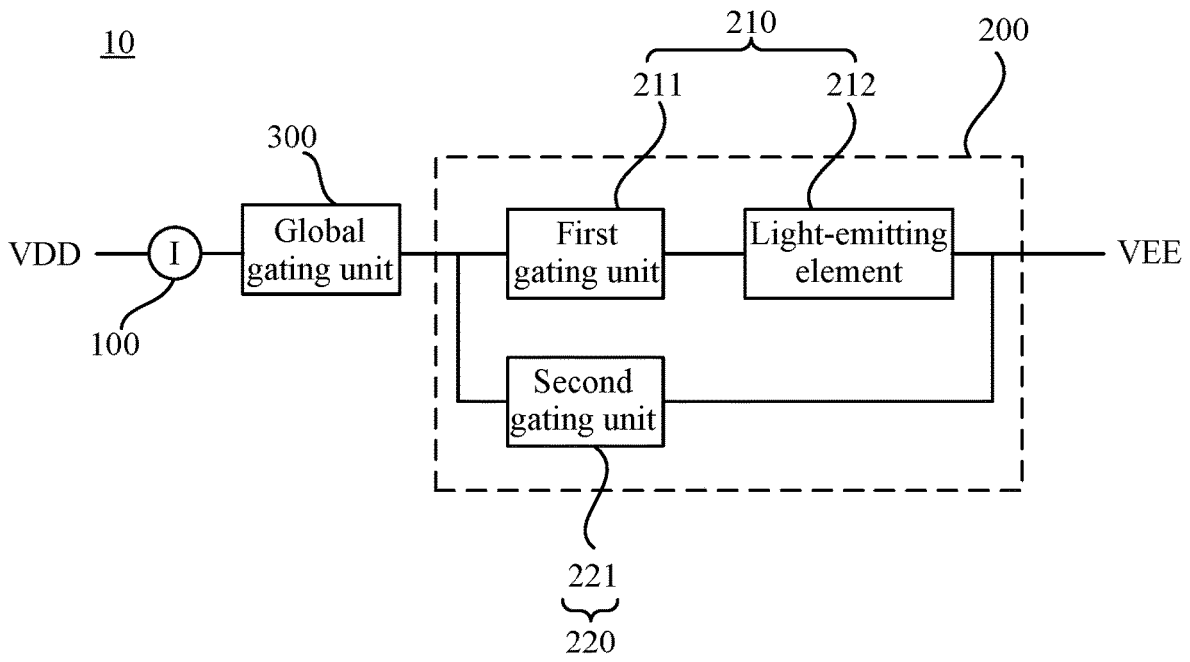
FIG. 10 is a schematic diagram of another light-emitting element control circuit according to an embodiment of the present disclosure.

FIG. 10 is a schematic diagram of another light-emitting element control circuit according to an embodiment of the present disclosure.

As shown in FIG. 10, the light-emitting element control circuit 10 includes the current source 100, the light-emitting unit 200, and a global gating unit 300 connected in series between the current source 100 and the light-emitting unit 200. When the light-emitting element 212 of each light-emitting unit 200 connected in series to the current source 100 does not need to emit light, the global gating unit 300 can cut off the power supply to save the power consumption.

Figure 11:
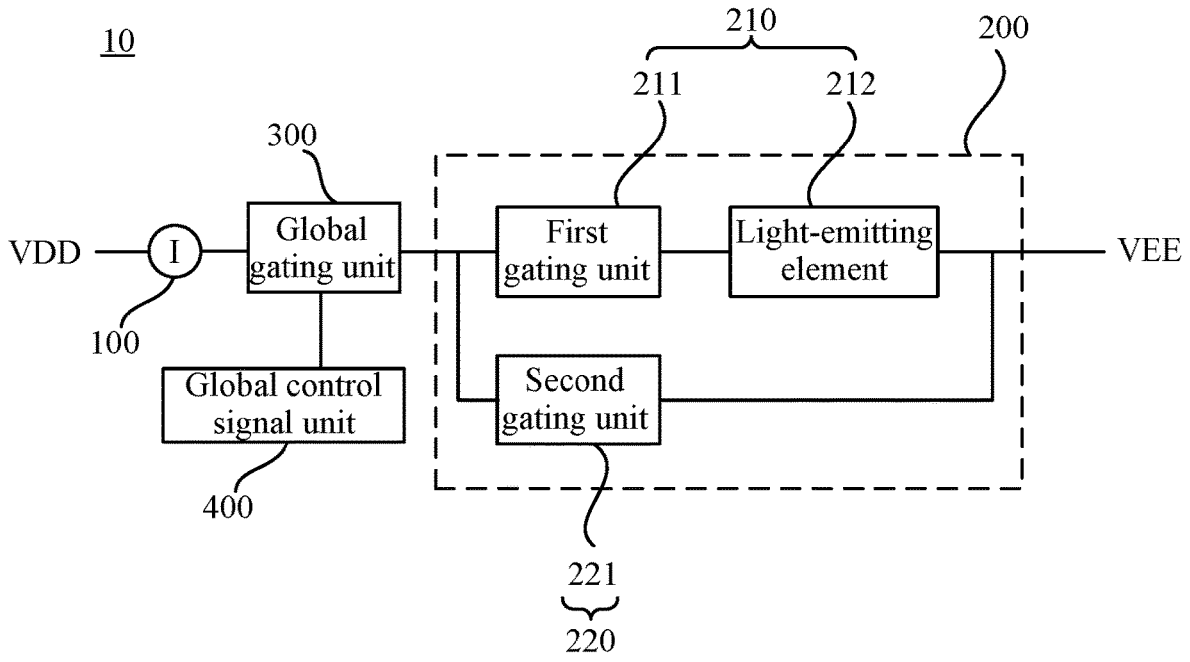
FIG. 11 is a schematic diagram of another light-emitting element control circuit according to an embodiment of the present disclosure.

FIG. 11 is a schematic diagram of another light-emitting element control circuit according to an embodiment of the present disclosure.

As shown in FIG. 11, on the basis of the light-emitting element control circuit 10 shown in FIG. 10, a global control signal unit 400 is further included. The global control signal unit 400 is electrically connected to a control terminal of the global gating unit 300 and used for transmitting a control signal to the control terminal of the global gating unit 300 to control the on or off of the global gating unit 300.

Figure 12:
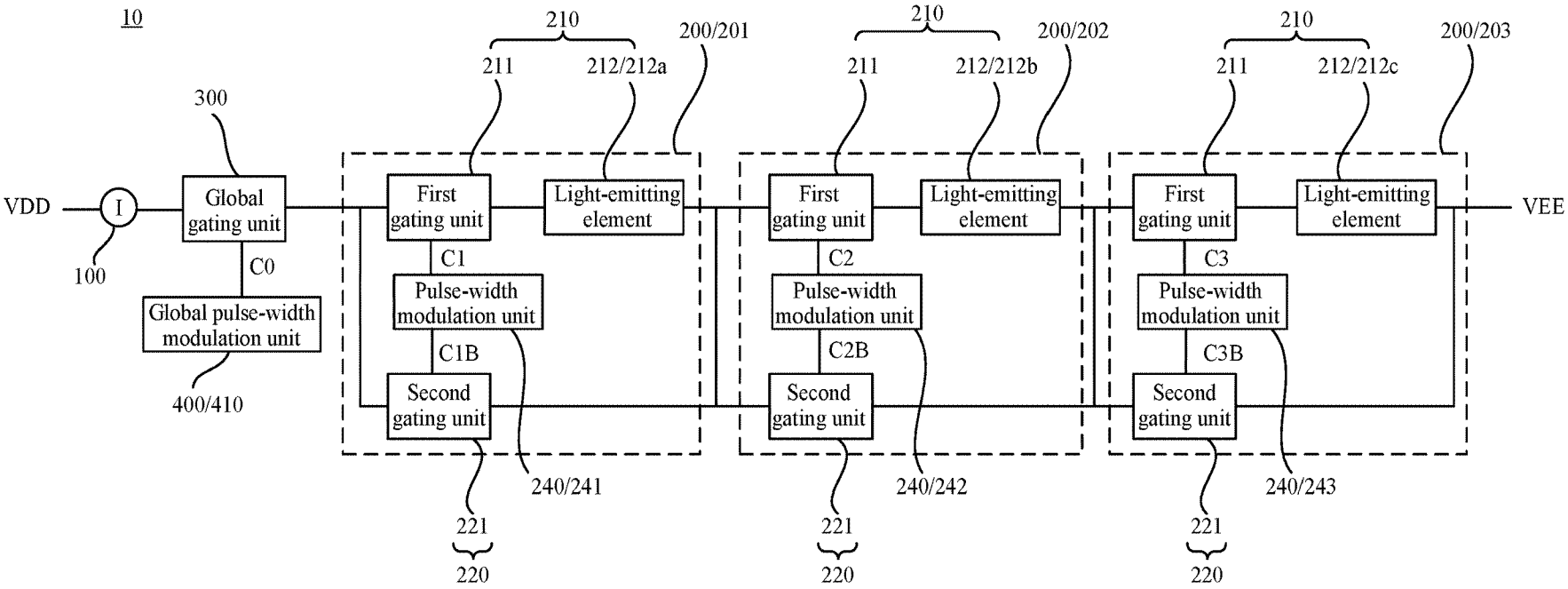
FIG. 12 is a schematic diagram of another light-emitting element control circuit according to an embodiment of the present disclosure.

FIG. 12 is a schematic diagram of another light-emitting element control circuit according to an embodiment of the present disclosure.

As shown in FIG. 12, the light-emitting element control circuit 10 includes the current source 100, the global gating unit 300, a first light-emitting unit 201, a second light-emitting unit 202, and a third light-emitting unit 203 which are sequentially connected in series. In the first light-emitting unit 201, the pulse-width modulation unit 240 is a first pulse-width modulation unit 241, and the first pulse-width modulation unit 241 is configured to provide a control signal C1 to the first gating unit 211 to control the light emission duration of the first light-emitting element 212*a* and provide a control signal C1B to the second gating unit 221. Similarly, in the second light-emitting unit 202, a second pulse-width modulation unit 242 is configured to provide a control signal C2 to the first gating unit 211 to control the light emission duration of the second light-emitting element 212*b* and provide a control signal C2B to the second gating unit 221. In the third light-emitting unit 203, a third pulse-width modulation unit 243 is configured to provide a control signal C3 to the first gating unit 211 to control the light emission duration of the third light-emitting element 212*c* and provide a control signal C3B to the second gating unit 221.

In conjunction with FIGS. 3, 4 and 12, the control signals C1 and C1B provided by the first pulse-width modulation unit 241 may be the same signal and are both the control signal C in FIG. 3 or FIG. 4. The control signals C2 and C2B provided by the second pulse-width modulation unit 242 and the control signals C3 and C3B provided by the third pulse-width modulation unit 243 may be understood in the same way.

Figure 13:
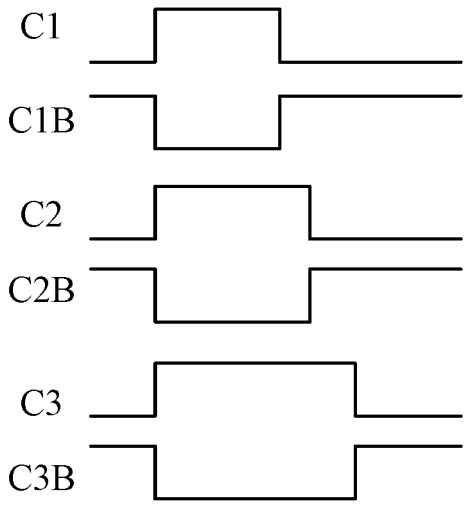
FIG. 13 is a timing diagram of control signals provided by the pulse-width modulation unit of FIG. 12.

If the control signal C1 provided by the first pulse-width modulation unit 241 is directly transmitted to the control terminal of the first gating unit 211, the control signal C1B provided by the first pulse-width modulation unit 241 is directly transmitted to the control terminal of the second gating unit 221, and the type of the transistor of the first gating unit 211 is the same as the type of the transistor of the second gating unit 221, the control signal C1 and the control signal C1B are inverted signals with each other. FIG. 13 is a timing diagram of control signals provided by the pulse-width modulation unit of FIG. 12. As shown in FIG. 13, at the same moment, one of the control signals C1 and C1B is at a high level and the other one is at a low level. Similarly, the control signals C2 and C2B provided by the second pulse-width modulation unit 242 and the control signals C3 and C3B provided by the third pulse-width modulation unit 243 may be understood in the same way.

In one embodiment, the first pulse-width modulation unit 241, the second pulse-width modulation unit 242, and the third pulse-width modulation unit 243 may be a same pulse-width modulation unit 240, that is, the same pulse-width modulation unit 240 provides pulse-width modulation signals to the first light-emitting unit 201, the second light-emitting unit 202, and the third light-emitting unit 203 separately.

Figure 14:
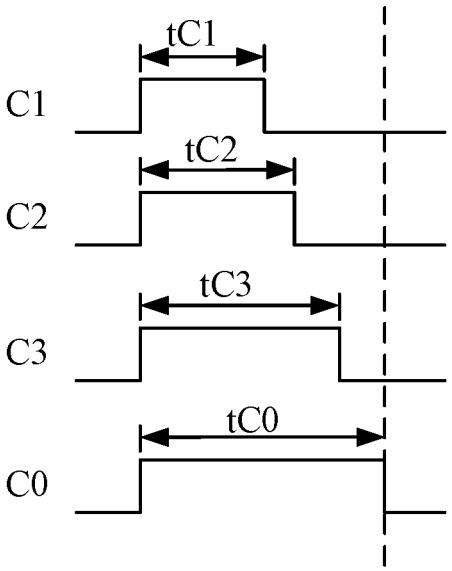
FIG. 14 is a timing diagram of control signals provided by the pulse-width modulation units and a control signal provided by a global pulse-width modulation unit of FIG. 12.

FIG. 14 is a timing diagram of control signals provided by the pulse-width modulation units and a control signal provided by a global pulse-width modulation unit of FIG. 12.

In conjunction with FIG. 12 and FIG. 14, in the light-emitting element control circuit 10, the global control signal unit 400 includes the global pulse-width modulation unit 410, and a time period in which the global pulse-width modulation unit 410 outputs an enable signal covers a preset light-emitting time period of the light-emitting element 212 of each light-emitting unit 200 connected in series to the current source 100 in time.

As shown in FIG. 14, a time period tC1 of an enable signal of the control signal C1 provided by the first pulse-width modulation unit 241 is a preset light-emitting time period of the first light-emitting element 212*a*, a time period tC2 of an enable signal of the control signal C2 provided by the second pulse-width modulation unit 242 is a preset light-emitting time period of the second light-emitting element 212*b*, a time period tC3 of an enable signal of the control signal C3 provided by the third pulse-width modulation unit 243 is a preset light-emitting time period of the third light-emitting element 212*c*, and the time period tC0 of the enable signal of the signal C0 output by the global pulse-width modulation unit 410 covers the preset light-emitting time period of the first light-emitting element 212*a*, the preset light-emitting time period of the second light-emitting element 212*b*, and the preset light-emitting time period of the third light-emitting element 212*c* in time. The duration of the time period tC0 may be greater than or equal to the duration of the preset light-emitting time period having the longest duration among the preset light-emitting periods of the light-emitting elements. For example, in the case shown in FIG. 14, the duration of the time period tC0 is greater than or equal to the duration of the time period tC3.

It is to be noted that FIG. 14 illustrates an example in which the starting light-emitting time of each light-emitting element is the same, and in other embodiments, the starting light-emitting time of each light-emitting element may be different. The time period tC0 of the enable signal of the signal C0 output by the global pulse-width modulation unit 410 overlaps all the preset light-emitting time periods of the light-emitting elements in time so that the current provided by the current source 100 can pass through the light-emitting elements to enable the light-emitting elements to normally emit light in the preset light-emitting time periods of the light-emitting elements.

The preset light-emitting time period of the light-emitting element corresponds to a gray scale of a pixel point of image information to be displayed, and the gray scale of the pixel point of the image information is represented by a data signal, so that the data signal is provided to the pulse-width modulation unit to implement the gray scale of the pixel point of the image information. The higher the gray scale of the pixel point, the longer the duration of the preset light-emitting time period of the light-emitting element, and the greater the brightness of the light-emitting element. The size of the duration of the preset light-emitting periods tC1, tC2, and tC3 in FIG. 14 is only illustrative. In actual implementation, the duration of the preset light-emitting time periods of the control signals C1, C2, and C3 is related to the image to be actually displayed, and the preset light-emitting duration of each control signal can be determined according to the data signal.

The global control signal unit includes an OR gate, the OR gate includes at least two input terminals and one output terminal, the at least two input terminals receive signals received by the control terminals of the first gating units of the light-emitting units connected in series to the current source, and the output terminal outputs a signal obtained after an OR operation is performed on the signal received by the at least two input terminals. The output terminal of the OR gate is electrically connected to a control terminal of the global gating unit.

Figure 15:
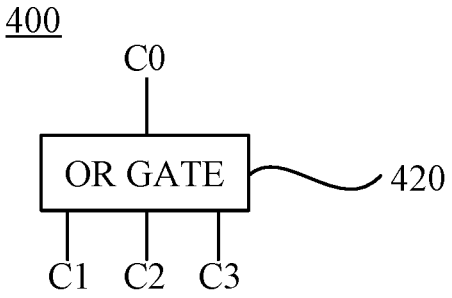
FIG. 15 is a schematic diagram of a global control signal unit according to an embodiment of the present disclosure.

FIG. 15 is a schematic diagram of a global control signal unit according to an embodiment of the present disclosure.

In conjunction with FIGS. 12 and 15, the global control signal unit 400 includes the OR gate 420. FIG. 15 illustrates that OR gate 420 includes three input terminals. The three input terminals respectively receive a signal C1 received by the control terminal of the first gating unit 211 of the first light-emitting unit 201, a signal C2 received by the control terminal of the first gating unit 211 of the second light-emitting unit 202, and a signal C3 received by the control terminal of the first gating unit 211 of the third light-emitting unit 203. The OR gate 420 performs the OR operation on the signals C1, C2, and C3, and outputs a result of the operation such as the signal C0 in FIG. 15 from the output terminal of the OR gate 420 to the control terminal of the global gating unit 300. On the one hand, in the preset light-emitting time period of any one of the first light-emitting element 212*a*, the second light-emitting element 212*b*, and the third light-emitting element 212*c*, the global gating unit 300 is in the on state, so that the current of the current source 100 can pass through each light-emitting element 21; and in a time period when all of the first light-emitting element 212*a*, the second light-emitting element 212*b*, and the third light-emitting element 212*c* do not emit light, the global gating unit 300 is in the off state, so that the power consumption is saved. On the other hand, the control signals in the light-emitting unit 200 are used to form the control signal of the global gating unit 300, thereby simplifying the complexity of signal setting.

The light-emitting element control circuit further includes a first power supply terminal and a second power supply terminal, and a voltage of the first power supply terminal is higher than a voltage of the second power supply terminal.

As shown in FIG. 1, the current source 100 and the light-emitting unit 200 are connected in series between the first power supply terminal VDD and the second power supply terminal VEE, and the voltage of the first power supply terminal VDD is higher than the voltage of the second power supply terminal VEE. For example, the voltage of the first power supply terminal VDD ranges from 0 V to 8 V, and the voltage of the second power supply terminal VEE ranges from −8 V to 0 V.

In order to improve the degree of integration of the light-emitting element control circuit, the light-emitting element control circuit may include a microcontroller. The current source and components other than the light-emitting element in the light-emitting unit are integrated in the microcontroller, and the light-emitting element is electrically connected to the microcontroller.

Figure 16:
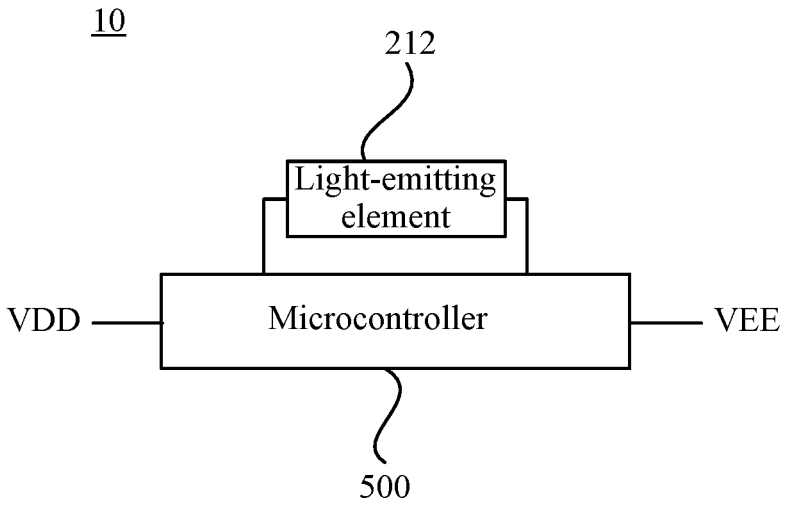
FIG. 16 and FIG. 17 are schematic diagrams of a light-emitting element control circuit including a microcontroller according to an embodiment of the present disclosure.
Figure 17:
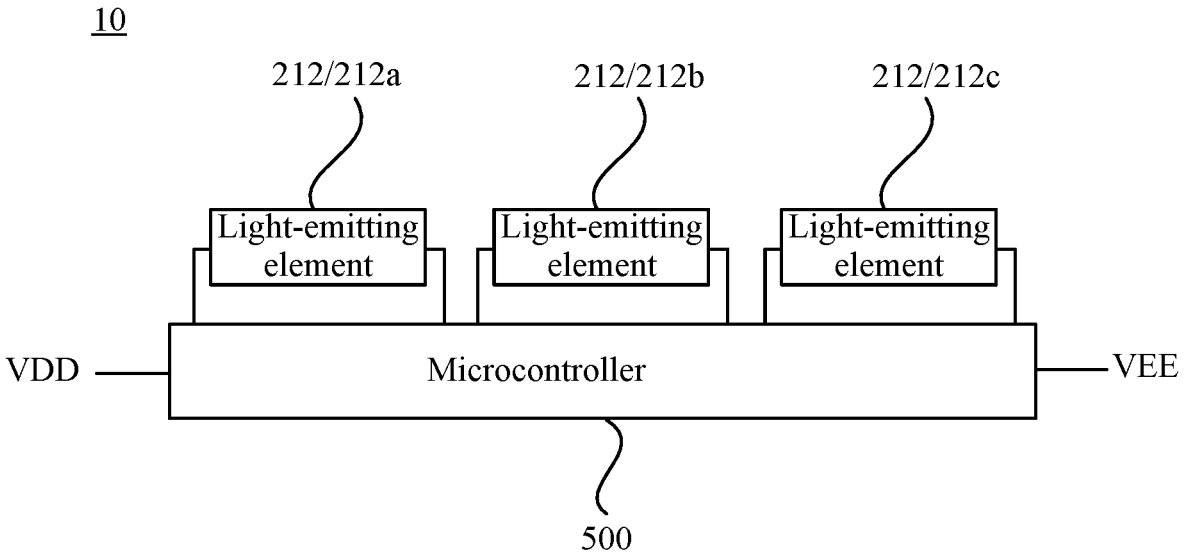

FIG. 16 and FIG. 17 are schematic diagrams of a light-emitting element control circuit including a microcontroller according to an embodiment of the present disclosure.

As shown in FIGS. 1, 16, and 17, the light-emitting element control circuit 10 includes the microcontroller 500, the current source 100 of the light-emitting element control circuit 10 and the first gating unit 211 and the second gating unit 221 in the light-emitting unit 200 are integrated in the microcontroller 500, and the light-emitting element 212 in the light-emitting unit 200 is electrically connected to the microcontroller 500 instead of being disposed in the microcontroller 500.

The microcontroller 500 may be an integrated circuit (IC), and for example, a germanium wafer or a silicon wafer is used to serve as a circuit of a circuit board.

In conjunction with FIGS. 4 and 16, the inverter 230 of the light-emitting element control circuit 10 may be integrated into the microcontroller 500, and the microcontroller 500 includes the input terminal that receives the control signal C.

In conjunction with FIGS. 6 and 16, the pulse-width modulation unit 240 of the light-emitting element control circuit 10 may be integrated into the microcontroller 500, and the microcontroller 500 includes the input terminal that receives the data signal and used for providing the data signal to the pulse-width modulation unit 240.

FIG. 16 illustrates a case where the light-emitting element control circuit 10 includes one light-emitting unit 200. FIG. 17 illustrates a case where the light-emitting element control circuit 10 includes three light-emitting units 200. The light-emitting elements (212*a*, 212*b*, and 212*c*) of the three light-emitting units 200 are independent of and electrically connected to the microcontroller 500, respectively.

In conjunction with FIGS. 11, 12, 16 and 17, the global gating unit 300 and the global control signal unit 400 are also integrated into the microcontroller, further improving the degree of integration of the circuit. The input terminal of the global control signal unit 400 may be implemented through the setting of the input terminal of the microcontroller 500.

Still referring to FIGS. 16 and 17, the microcontroller 500 is further electrically connected to the first power supply terminal VDD and the second power supply terminal VEE, and the first power supply terminal VDD and the second power supply terminal VEE are used for providing a positive power supply voltage and a negative power supply voltage to the microcontroller 500, respectively.

Figure 18:
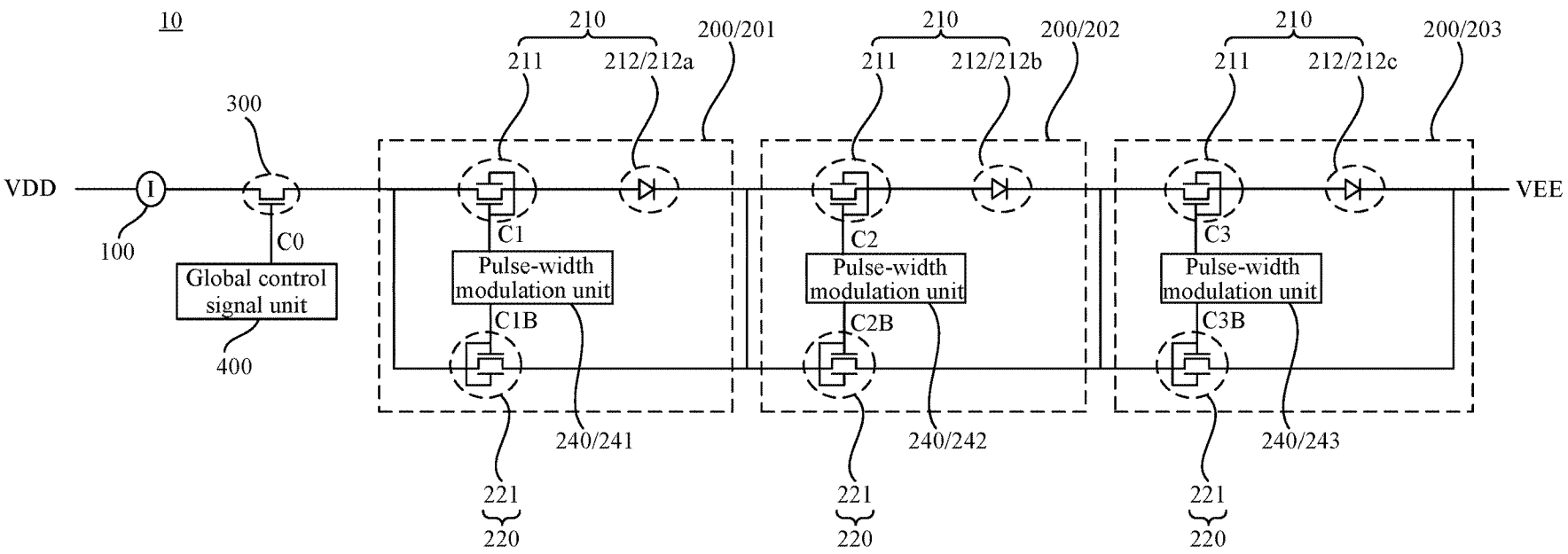
FIG. 18 is a schematic diagram of another light-emitting element control circuit according to an embodiment of the present disclosure.
Figure 19:
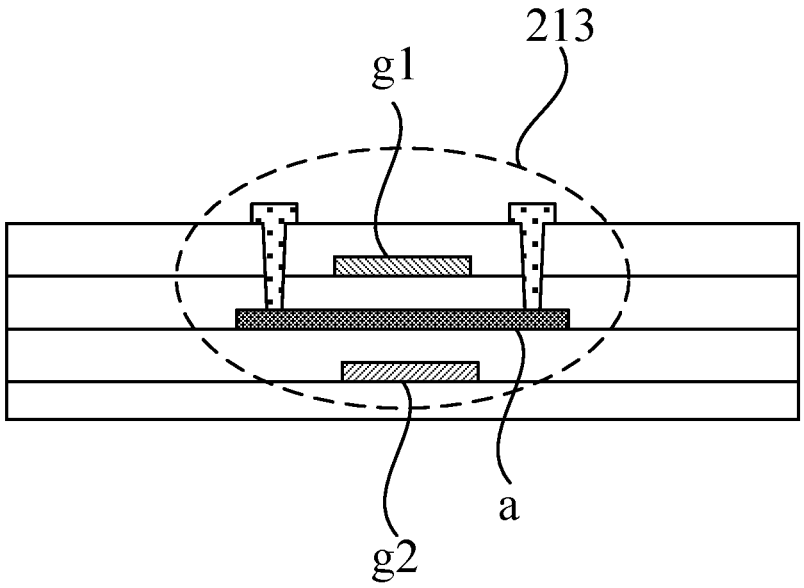
FIG. 19 is a film structure diagram of a gating transistor according to an embodiment of the present disclosure.

FIG. 18 is a schematic diagram of another light-emitting element control circuit according to an embodiment of the present disclosure. FIG. 19 is a film structure diagram of a gating transistor according to an embodiment of the present disclosure.

As shown in FIGS. 18 and 19, at least one of the first gating unit 211 and the second gating unit 221 of the light-emitting unit 200 includes a gating transistor 213. The gating transistor 213 includes an active layer a and a first gate g1 and a second gate g2 respectively located on opposite sides of the active layer a, and the first gate g1 is electrically connected to the second gate g2.

FIG. 18 illustrates an example in which the first gating unit 211 and the second gating unit 221 of the light-emitting unit 200 each include the gating transistor 213. In other embodiments, one of the first gating unit 211 and the second gating unit 221 may be set as the gating transistor 213.

The first gating unit 211 and/or the second gating unit 221 is set as a three-dimensional double-gate transistor, and the first gate g1 is electrically connected to the second gate g2, so that a response speed of the gating unit is improved and the power consumption on the gating unit is reduced at the same time.

In the light-emitting element control circuit 10, light-emitting colors of light-emitting elements 212 in the at least two light-emitting units 200 are different. The light-emitting color of the light-emitting element 212 may be one of red, green or blue, or the light-emitting color may be one of red, green, blue or white.

FIG. 9 illustrates an example in which the light-emitting element control circuit 10 includes two light-emitting units 200. The light-emitting color of the light-emitting element 212 of the first light-emitting unit 201 may be different from the light-emitting color of the light-emitting element 212 of the second light-emitting unit 202.

FIG. 12 illustrates an example in which the light-emitting element control circuit 10 includes three light-emitting units 200. The light-emitting elements 212 of the three light-emitting units 200 may be a red light-emitting element, a green light-emitting element, and a blue light-emitting element separately.

If the light-emitting element control circuit 10 includes four light-emitting units 200, the light-emitting elements 212 of the four light-emitting units 200 may include light-emitting elements of three colors, and two light-emitting elements among the light-emitting elements 212 of the four light-emitting units 200 have one color. For example, two red light-emitting elements, one green light-emitting element, and one blue light-emitting element may be included. Alternatively, the light-emitting colors of the light-emitting elements 212 of the four light-emitting units 200 are red, green, blue, and white separately.

The light-emitting element 212 of the light-emitting unit 200 may include one of an organic light-emitting diode and an inorganic light-emitting diode. The inorganic light-emitting diode is described as an example. The structure of the light-emitting element includes an N-type semiconductor layer and a P-type semiconductor layer which are stacked and a quantum well layer disposed between the N-type semiconductor layer and the P-type semiconductor layer. In addition, the structure of the light-emitting element further includes a first electrode and a second electrode for supplying a positive voltage and a negative voltage to the light-emitting element 212.

Based on the same inventive concept, an embodiment of the present disclosure further provides a display panel including the light-emitting element control circuit 10 of any one of the preceding embodiments.

Figure 20:
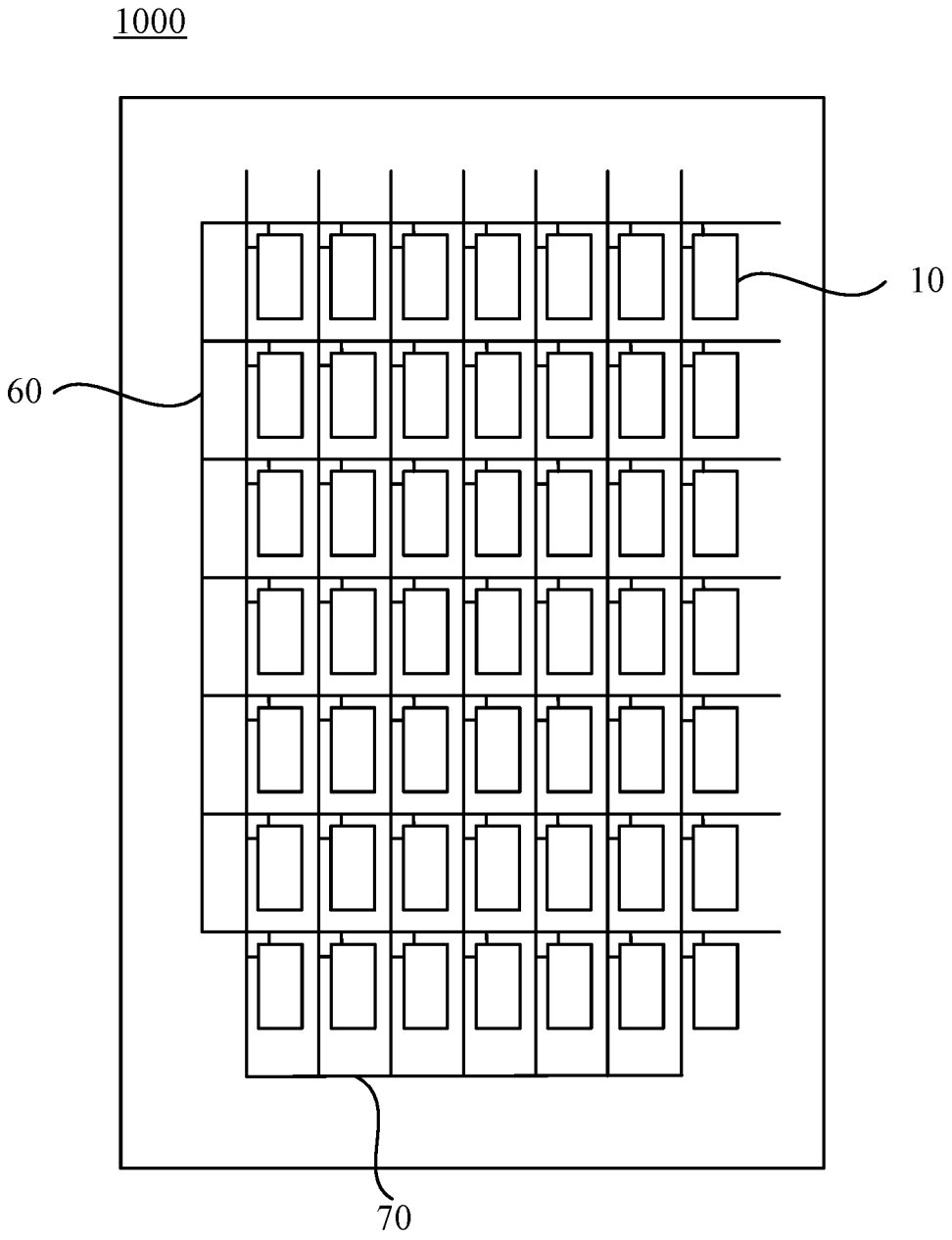
FIG. 20 is a schematic diagram of a display panel according to an embodiment of the present disclosure.

FIG. 20 is a schematic diagram of a display panel according to an embodiment of the present disclosure.

As shown in FIG. 20, the display panel 1000 may include multiple light-emitting element control circuits 10, the multiple light-emitting element control circuits 10 may be arranged in an array, and the light-emitting element control circuit 10 may serve as pixel for displaying an image.

The light-emitting element control circuit 10 is electrically connected to a first power supply line 60 and a second power supply line 70 separately. The first power supply line 60 is configured to provide the first power supply voltage VDD, and the second power supply line 70 is configured to provide the second power supply voltage VEE. The first power supply lines 60 connected to a plurality of rows of light-emitting element control circuits 10 may be electrically connected to each other and configured to provide a same first power supply voltage VDD. The second power supply lines 70 connected to a plurality of columns of light-emitting element control circuits 10 may be electrically connected to each other and configured to provide a same second power supply voltage VEE.

Figure 21:
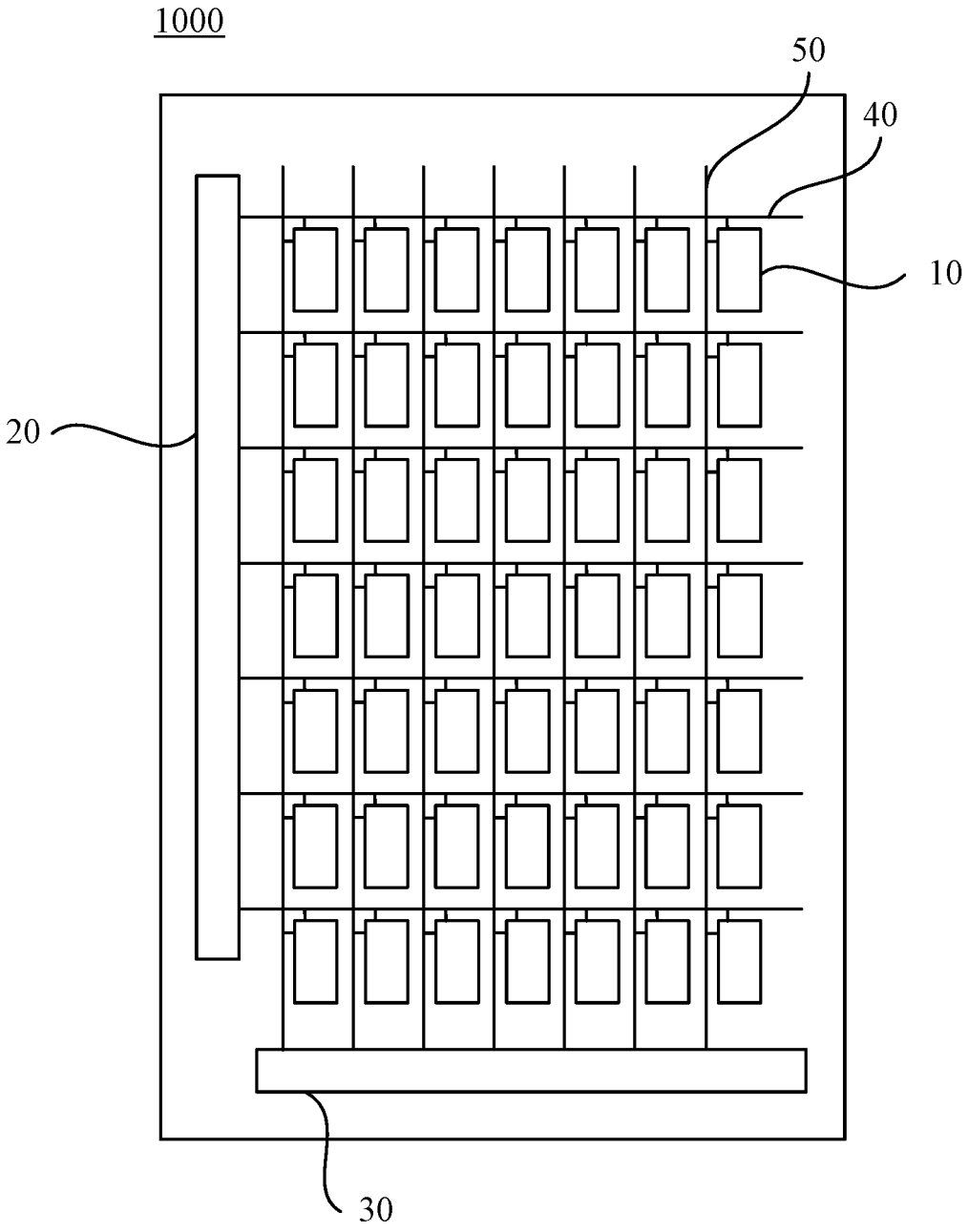
FIG. 21 is a schematic diagram of another display panel according to an embodiment of the present disclosure.

FIG. 21 is a schematic diagram of another display panel according to an embodiment of the present disclosure.

As shown in FIG. 21, the display panel 1000 may include multiple light-emitting element control circuits 10, the multiple light-emitting element control circuits 10 may be arranged in an array, and the light-emitting element control circuit 10 may serve as pixel for displaying an image.

The display panel 1000 may further include a scanning driver circuit 20 and a data driver circuit 30. The scanning driver circuit 20 is electrically connected to the light-emitting element control circuit 10 through a scanning signal line 40 and used for providing a scanning signal to the light-emitting element control circuit 10. The data driver circuit 30 provides the data signal to the light-emitting element control circuit 10 through a data signal line 50, and the data signal is input row by row through the cooperation of the scanning driver circuit 20 and the data driver circuit 30.

In one embodiment, the display panel may include the data driver circuit 30. The data driver circuit 30 may be electrically connected to the light-emitting element control circuit 10 through the data signal line 50 and transmit the data signal to the light-emitting element control circuit 10.

Structure of the display panels shown in FIGS. 20 and 21 may be organically combined with each other.

Based on the same inventive concept, an embodiment of the present disclosure further provides a display device including the display panel of any one of the preceding embodiments.

Figure 22:
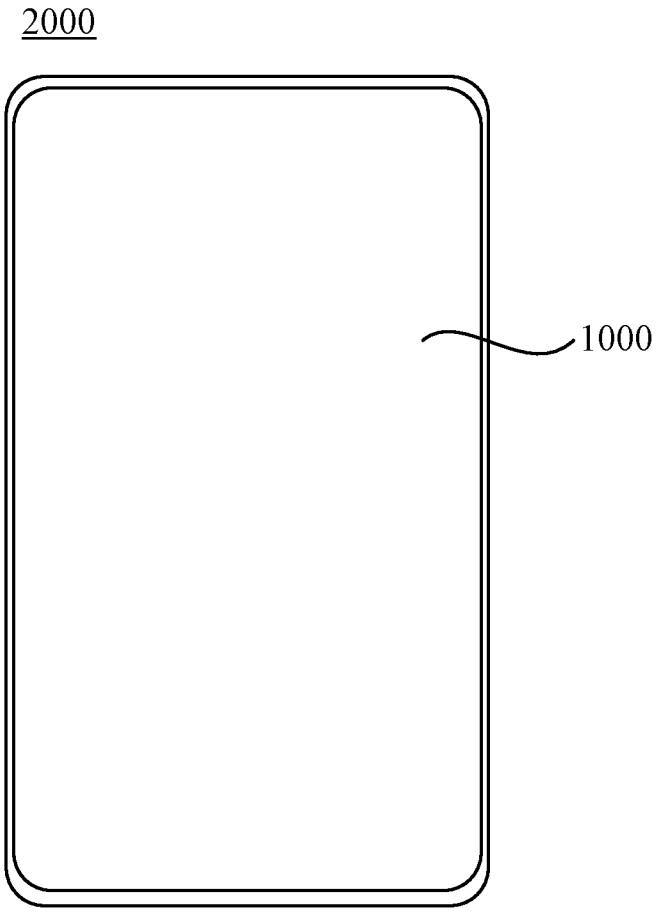
FIG. 22 is a schematic diagram of a display device according to an embodiment of the present disclosure.

Specifically, the display device may be any electronic product with display functions and includes but is not limited to the following categories: mobile phones, televisions, laptops, desktop displays, tablet computers, digital cameras, smart bracelets, smart glasses, vehicle-mounted displays, medical equipment, industrial control equipment, touch interactive terminals. FIG. 22 is a schematic diagram of a display device according to an embodiment of the present disclosure. FIG. 22 schematically illustrates the display device 2000 of the present disclosure with the mobile phone, and the display device 2000 includes the display panel 1000.

The above description of the disclosed embodiments enables those skilled in the art to implement or use the present disclosure. Various modifications to these embodiments will be apparent to those skilled in the art, and the general principles defined herein may be implemented in other embodiments without departing from the spirit or scope of the disclosure. Therefore, the present disclosure is not intended to be limited to the embodiments shown herein but is to be accorded the widest scope consistent with the principles and novel features disclosed herein.

What is claimed is:

1. A light-emitting element control circuit, comprising: a current source and at least one light-emitting unit; wherein the at least one light-emitting unit is connected in series to the current source; and the at least one light-emitting unit each comprises a first branch and a second branch, wherein the first branch and the second branch are connected in parallel, and wherein the first branch comprises a first gating unit and a light-emitting element connected in series to the first gating unit, and the second branch comprises a second gating unit, wherein one of the first gating unit and the second gating unit is an N-type transistor and the other one of the first gating unit and the second gating unit is a P-type transistor, and a control terminal of the N-type transistor is electrically connected to a control terminal of the P-type transistor.

2. The light-emitting element control circuit of claim 1, wherein in response to the first gating unit being in an on state, the second gating unit is in an off state; and in response to the second gating unit being in an on state, the first gating unit is in an off state.

3. The light-emitting element control circuit of claim 2, wherein the at least one light-emitting unit further comprises an inverter, and a control terminal of the first gating unit is electrically connected to a control terminal of the second gating unit through the inverter.

4. The light-emitting element control circuit of claim 1, wherein the at least one light-emitting unit further comprises a pulse-width modulation unit, and the pulse-width modulation unit is electrically connected to the first gating unit and the second gating unit separately.

5. The light-emitting element control circuit of claim 4, wherein the pulse-width modulation unit is configured to receive a data signal and output a pulse-width modulation signal corresponding to the data signal.

6. The light-emitting element control circuit of claim 1, wherein at least two light-emitting units are provided and connected in series.

7. The light-emitting element control circuit of claim 6, wherein light-emitting colors of light-emitting elements in the at least two light-emitting units are different.

8. The light-emitting element control circuit of claim 1, wherein the current source and the at least one light-emitting unit are connected in series between a first power supply terminal and a second power supply terminal, and a voltage of the first power supply terminal is higher than a voltage of the second power supply terminal.

9. The light-emitting element control circuit of claim 1, comprising a microcontroller, wherein the current source and components other than the light-emitting element in the at least one light-emitting unit are integrated in the microcontroller; and the microcontroller is electrically connected to the light-emitting element.

10. The light-emitting element control circuit of claim 9, further comprising a global gating unit and a global control signal unit; wherein the global gating unit is connected in series between the current source and the at least one light-emitting unit;

the global control signal unit is electrically connected to a control terminal of the global gating unit; and the global gating unit and the global control signal unit are integrated into the microcontroller.

11. The light-emitting element control circuit of claim 9, wherein the current source and the at least one light-emitting unit are connected in series between a first power supply terminal and a second power supply terminal, and a voltage of the first power supply terminal is higher than a voltage of the second power supply terminal, and the microcontroller is further electrically connected to the first power supply terminal and the second power supply terminal.

12. The light-emitting element control circuit of claim 1, wherein at least one of the first gating unit and the second gating unit comprises a gating transistor, the gating transistor comprises an active layer and a first gate and a second gate respectively located on opposite sides of the active layer, and the first gate is electrically connected to the second gate.

13. A light-emitting element control circuit, comprising: a current source and at least one light-emitting unit; wherein the at least one light-emitting unit is connected in series to the current source; and the at least one light-emitting unit each comprises a first branch and a second branch, wherein the first branch and the second branch are connected in parallel, and wherein the first branch comprises a first gating unit and a light-emitting element connected in series to the first gating unit, and the second branch comprises a second gating unit, wherein the light-emitting element control circuit further comprising a global gating unit connected in series between the current source and the at least one light-emitting unit, wherein the light-emitting element control circuit further comprising a global control signal unit, wherein the global control signal unit is electrically connected to a control terminal of the global gating unit, wherein the global control signal unit comprises a global pulse-width modulation unit, and a time period of an enable signal output by the global pulse-width modulation unit covers a preset light-emitting time period of a light-emitting element of each light-emitting unit of the at least one light-emitting unit connected in series to the current source in terms of time.

14. A light-emitting element control circuit, comprising: a current source and at least one light-emitting unit; wherein the at least one light-emitting unit is connected in series to the current source; and the at least one light-emitting unit each comprises a first branch and a second branch, wherein the first branch and the second branch are connected in parallel, and wherein the first branch comprises a first gating unit and a light-emitting element connected in series to the first gating unit, and the second branch comprises a second gating unit, wherein the light-emitting element control circuit further comprising a global gating unit connected in series between the current source and the at least one light-emitting unit, wherein the light-emitting element control circuit further comprising a global control signal unit, wherein the global control signal unit is electrically connected to a control terminal of the global gating unit, wherein the global control signal unit comprises an OR gate, the OR gate comprises at least two input terminals and one output terminal, the at least two input terminals of the OR gate receive a signal received by a control terminal of a first gating unit of the each light-emitting unit connected in series to the current source, and the output terminal of the OR gate outputs a signal obtained after an OR operation is performed on the signal received by the at least two input terminals of the OR gate; and the output terminal of the OR gate is electrically connected to the control terminal of the global gating unit.

15. A display panel, comprising a light-emitting element control circuit, wherein the light-emitting element control circuit comprises: a current source and at least one light-emitting unit; wherein the at least one light-emitting unit is connected in series to the current source; and the at least one light-emitting unit each comprises a first branch and a second branch, wherein the first branch and the second branch are connected in parallel, and wherein the first branch comprises a first gating unit and a light-emitting element connected in series to the first gating unit, and the second branch comprises a second gating unit, wherein one of the first gating unit and the second gating unit is an N-type transistor and the other one of the first gating unit and the second gating unit is a P-type transistor, and a control terminal of the N-type transistor is electrically connected to a control terminal of the P-type transistor.

16. The display panel of claim 15, further comprising a scanning driver circuit and a data driver circuit; wherein the light-emitting element control circuit is electrically connected to the scanning driver circuit through a scanning signal line and electrically connected to the data driver circuit through a data signal line.

17. A display device, comprising the display panel of claim 15.

* * * * *